US006443433B1

(12) United States Patent
Auldridge

(10) Patent No.: US 6,443,433 B1
(45) Date of Patent: Sep. 3, 2002

(54) POST AND RAIL FENCE SYSTEM USING T-BARS

(76) Inventor: Douglas Auldridge, 3343 Country Rd., Omaha, TX (US) 75571

( * ) Notice: Subject to any disclaimer, the term of this patent is extended or adjusted under 35 U.S.C. 154(b) by 136 days.

(21) Appl. No.: 09/691,724

(22) Filed: Oct. 18, 2000

(51) Int. Cl.[7] ..... E04H 17/14

(52) U.S. Cl. ..... 256/68; 256/69; 403/169

(58) Field of Search ..... 403/187, 188, 403/192, 293, 341; 52/736.2, 731.7, 655.1, 656.9; 441/400, 383, 384; 248/227.3, 227.4, 228.5, 231.61, 229.14, 229.24, 230.5; 256/1, 21, 59, 64, 68, 69, 65.11, 65.16, 65.15

(56) References Cited

U.S. PATENT DOCUMENTS 4,007,993 A * 2/1977 Schwartz ..... 403/3
4,283,152 A * 8/1981 Smith et al. ..... 403/3
4,623,126 A * 11/1986 Pettit ..... 256/25
5,518,333 A * 5/1996 Cienkus, Jr. et al. ..... 403/169

FOREIGN PATENT DOCUMENTS

DE 32 45 599 * 6/1984 ..... E21D/11/15
GB 946 * 11/1904 ..... 256/65.02

* cited by examiner

*Primary Examiner*—Lynne H. Browne
*Assistant Examiner*—Michael P. Ferguson
(74) *Attorney, Agent, or Firm*—Goldstein & Lavas

(57) ABSTRACT

A fence system, using extruded bars of T-shaped cross-section to form posts and rails, and a plurality of connectors to connect the T-bars. The connectors have vertical and horizontal V-channels within which the T-bars are secured. Each V-channel has a pair of sides which meet at a vertex, and an open end. A plurality of clamping mechanisms each include a cross plate which extends across the open end of the V-channel to hold the T-bar therein, and a pair of J-bolts which secure to both the V-channel sides and the cross plate. An inverted U-channel extends between the cross plate and the T-bar to directly engage the T-bar and hold it tightly against the vertex of the V-channel. The T-bar has a plurality of spaced protuberances thereon. A transverse pin extends across the U-channel so that when the clamping mechanism is engaged with the T-bar, interference between the transverse pin and the protuberances prevent the T-bar from slipping longitudinally within the V-channels. Both upper and lower connectors may be provided at each post to provide a dual horizontal rail fence.

14 Claims, 4 Drawing Sheets

POST AND RAIL FENCE SYSTEM USING T-BARS

BACKGROUND OF THE INVENTION

The invention relates to a post and rail fence system. More particularly, the invention relates to a fence system which allows a post and rail fence to be easily created using commonly available bars of T-shaped cross section.

In certain industries, especially those which involve the maintenance of domesticated animals, it is necessary to fence in large expanses of land. In such situations, the ability to erect a fence quickly and inexpensively is of great importance.

Through the years, many types of fences have been developed, including traditional fences made with wooden posts and wire "rails", and modern fences with metal posts and rails.

One commonly used fence employs metal posts of T-shaped cross-section, with barbed wire stretched between the posts. Such a fence is useful for controlling animals and fencing in large expanses of land. In addition, the posts are commonly available in all locales. However, fences constructed in this manner have little structural strength—accordingly they have little ability to physically restrain a person, other than by cutting the person or animal. They can easily injure a person accidentally, as well. Accordingly, such fences have little value for use as a safety fence.

Further, pipe fences are available, which provide significant structural strength. However, such fences are prohibitively expensive for many purposes.

All of these fences vary in expense and in suitability for their intended purposes. Accordingly, while these units may be suitable for the particular purpose employed, or for general use, they would not be as suitable for the purposes of the present invention as disclosed hereafter.

SUMMARY OF THE INVENTION

It is an object of the invention to provide a fencing system which allows a fence to be easily constructed. Accordingly, the connectors of the present invention allow the fence to be constructed wherein both posts and rails are made from the same T-shaped bars. The T-shaped bars are commonly available in lumber and supply yards of all types. The bars are easily driven into the ground, and can secure in place without the need for concrete footings. Further, in accordance with the invention, the bars are quickly and easily joined using the connectors to create post and rail fencing.

It is another object of the invention to provide a fencing system which is inexpensive to install. Accordingly, in a multi-section fence, each fence section typically only requires one or two connectors and a few lengths of T-bar material.

It is a still further object of the invention to provide a fencing system which is of suitable strength and rigidity to provide a permanent installation, if desired, or may be quickly and non-destructively dismantled. Accordingly, the connectors fasten securely to the T-bars, are specially configured to resist slipping on the T-bars, and may be easily loosened for dismantling.

The invention is a fence system, using extruded bars of T-shaped cross-section to form posts and rails, and a plurality of connectors to connect the T-bars. The connectors have vertical and horizontal V-channels within which the T-bars are secured. Each V-channel has a pair of sides which meet at a vertex, and an open end. A plurality of clamping mechanisms each include a cross plate which extends across the open end of the V-channel to hold the T-bar therein, and a pair of J-bolts which secure to both the V-channel sides and the cross plate. An inverted U-channel extends between the cross plate and the T-bar to directly engage the T-bar and hold it tightly against the vertex of the V-channel. The T-bar has a plurality of spaced protuberances thereon. A transverse pin extends across the U-channel so that when the clamping mechanism is engaged with the T-bar, interference between the transverse pin and the protuberances prevent the T-bar from slipping longitudinally within the V-channels. Both upper and lower connectors may be provided at each post to provide a dual horizontal rail fence.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 3:
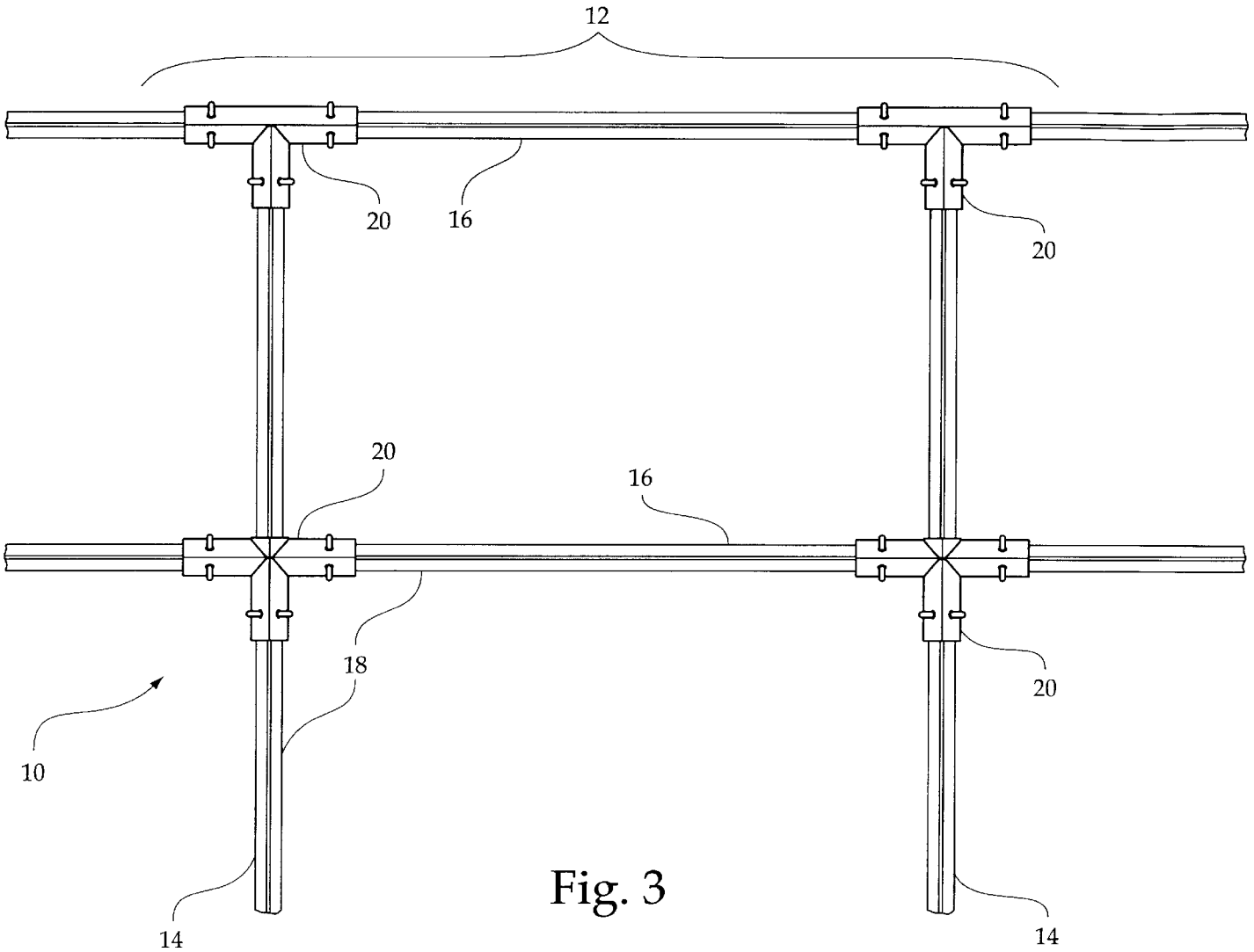
FIG. 3 is a side elevational view, illustrating a dual horizontal rail fence section, formed between two posts, which are each created using a pair of connectors as in FIG. 2.

FIG. 3 illustrates a fencing system 10, which is made of numerous fence sections 12, which are each bordered by a pair of posts 14, and are connected by one or more horizontal rails 16. In the typical configuration illustrated, two rails 16 are employed. However, the fence created in accordance with the present invention may easily have one, three, or four rails as well.

Seen in FIG. 3, in accordance with the present invention, the posts 14 and rails 16 of the fence are constructed using T-bars 18 of various lengths, and connectors 20. The T-bars are made of a commonly available extruded metal bar having a substantially T-shaped cross section. These T-bars are commonly used as stand-alone posts, where barbed wire is often stretched in between such posts. In the dual rail configuration illustrated, two connectors 20 are located at the post 14, wherein one connector is positioned directly vertically above the other connector, and the horizontal rails 16 extend parallel to the ground surface upon which the fence is mounted, and parallel to each other.

Figure 1:
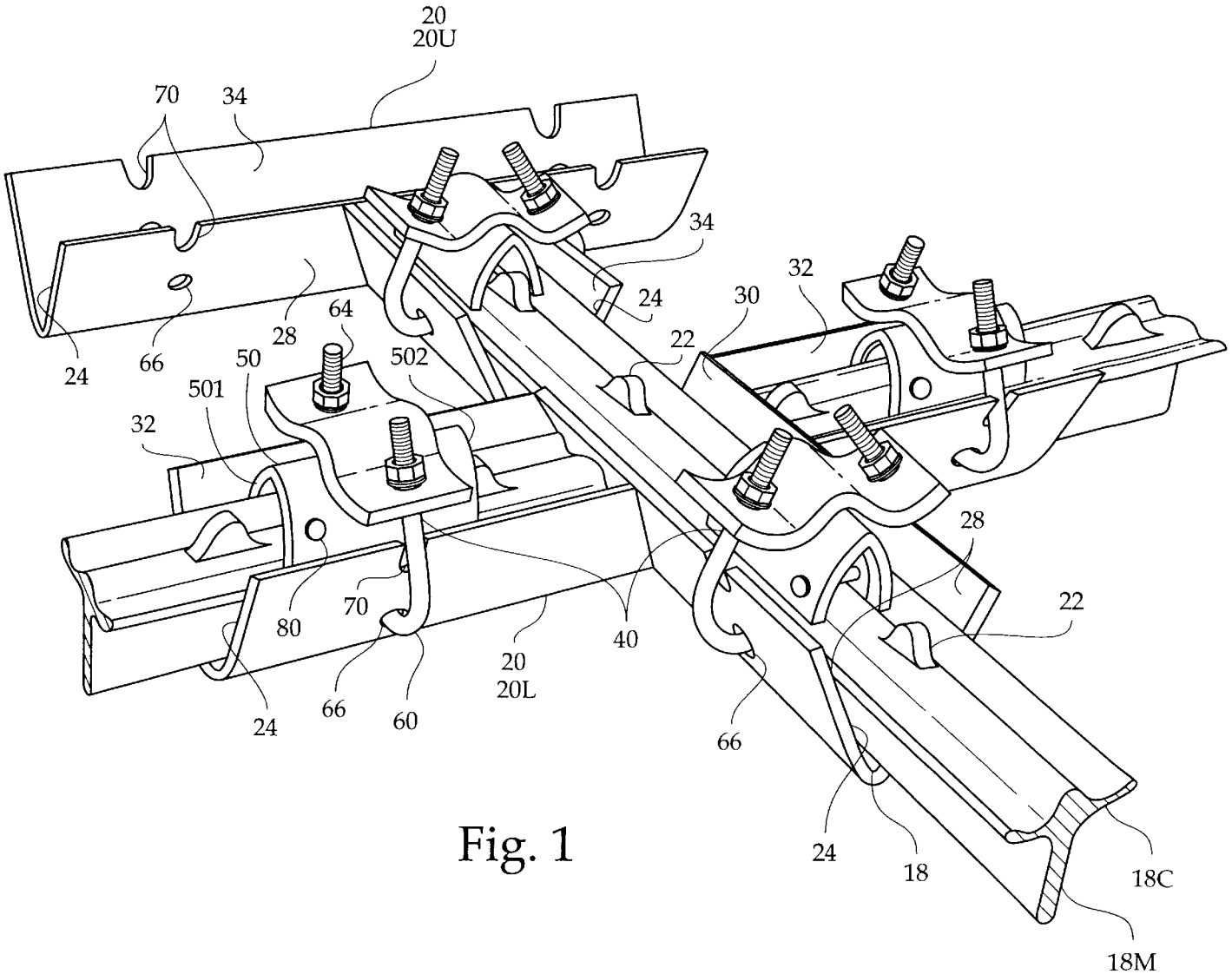
FIG. 1 is a diagrammatic perspective view, illustrating two connectors in use, interconnecting several T-bars, wherein the proximity of the two connectors is shown much closer than during ordinary usage for illustrative purposes only.
Figure 2:
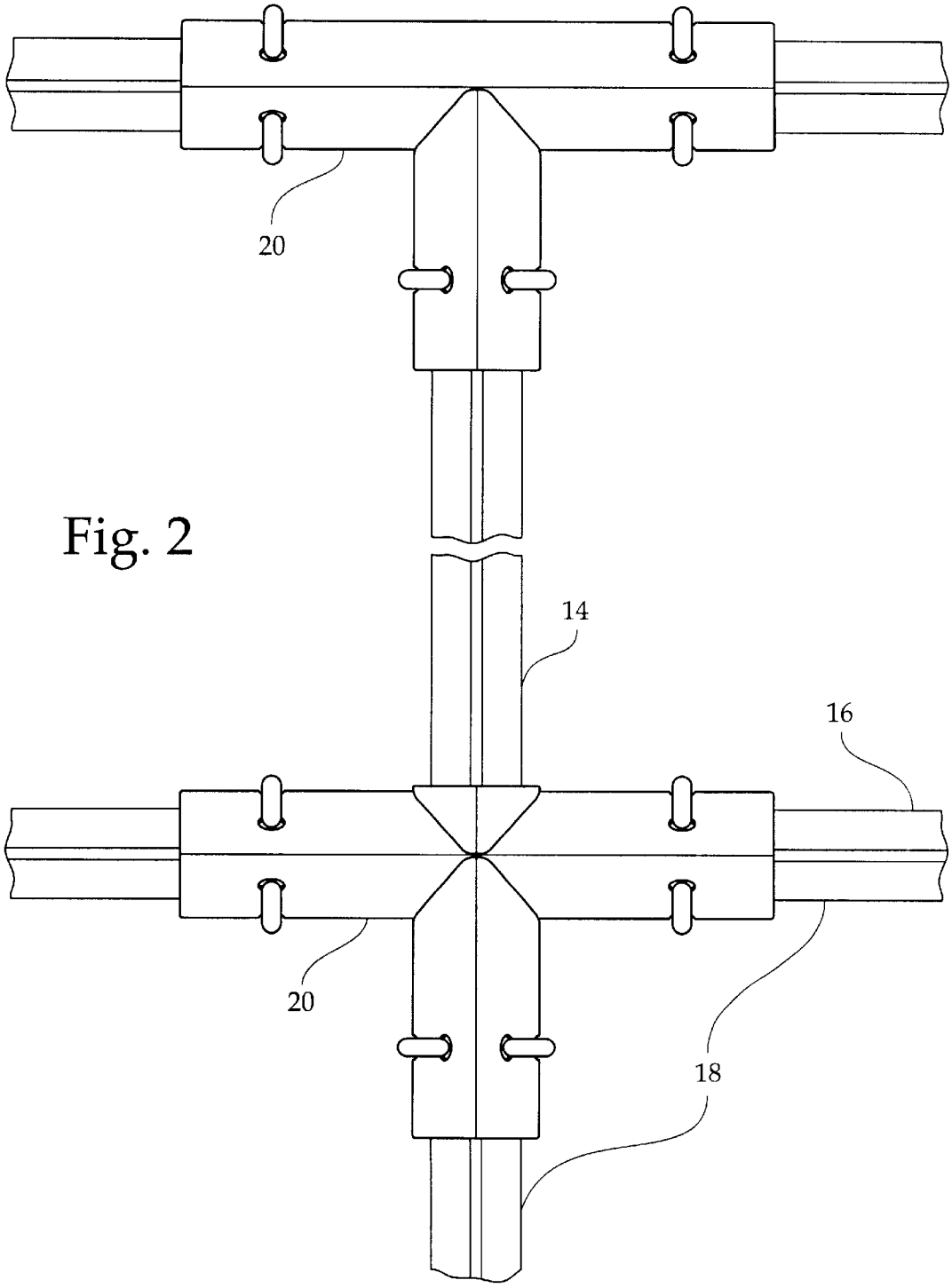
FIG. 2 is a side elevational view of a pair of connectors, joined to form a post of a dual railed fence, in accordance with the fencing system of the present invention.

Referring to FIG. 1, the T-bars 18 are elongated members having a T-shaped cross section, including a main leg 18M, and a cross leg 18C. The main leg 18M bisects the cross leg 18C. A plurality of protuberances 22 extend from and are centered on the cross leg 18C, and are also spaced longitudinally along said cross leg 18C.

Also seen in FIG. 1, each of the connectors 20 comprises an intersection of V-channels 24, each having a vertex 26, a pair of sides 28 which meet at the vertex 26, and an open end. The V-channels 24 are sized to accommodate the T-bars, such that the main leg 18M extends into the vertex 26, and cross leg 18C engages the sides 28.

Two types of connectors 20 are provided, in order to selectively allow one of the T-bars to extend through the connector 20, or terminate therein. In order to provide structural strength to the fence 10 of dual rail configuration, it is preferable that a T-bar extending vertically to help form the post 14 extend continuously through the lower of the connectors 20L of said post 14, and terminate at the upper of the connectors 20U of said post 14. Accordingly, the lower connector 20L is configured so as to have a vertical thru channel 30, and a pair of horizontal channels 32 which abut and terminate against the sides 28 of the vertical thru channel 30. Further, the upper connector 30U has a horizontal thru channel 34, and a vertical channel 36 which abuts and is terminated against one of the sides 28 of the horizontal thru channel 34.

Figure 5:
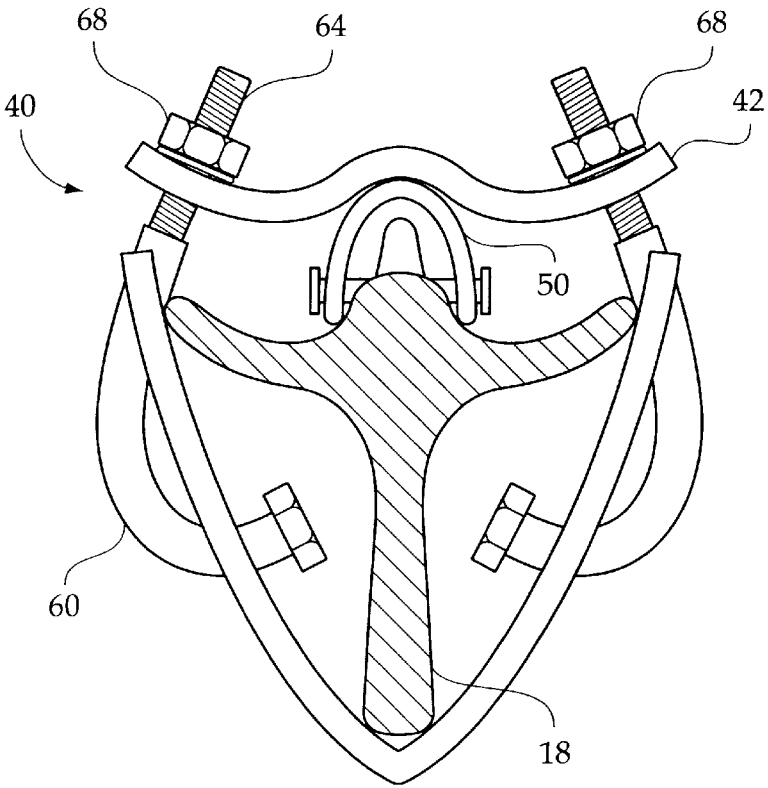
FIG. 5 is a side elevational view, illustrating one of the T-bars securely fastened into one of the connectors with the clamping mechanism, wherein the bradded pin of said clamping mechanism prevents the T-bar from sliding longitudinally within said connector.
Figure 4:
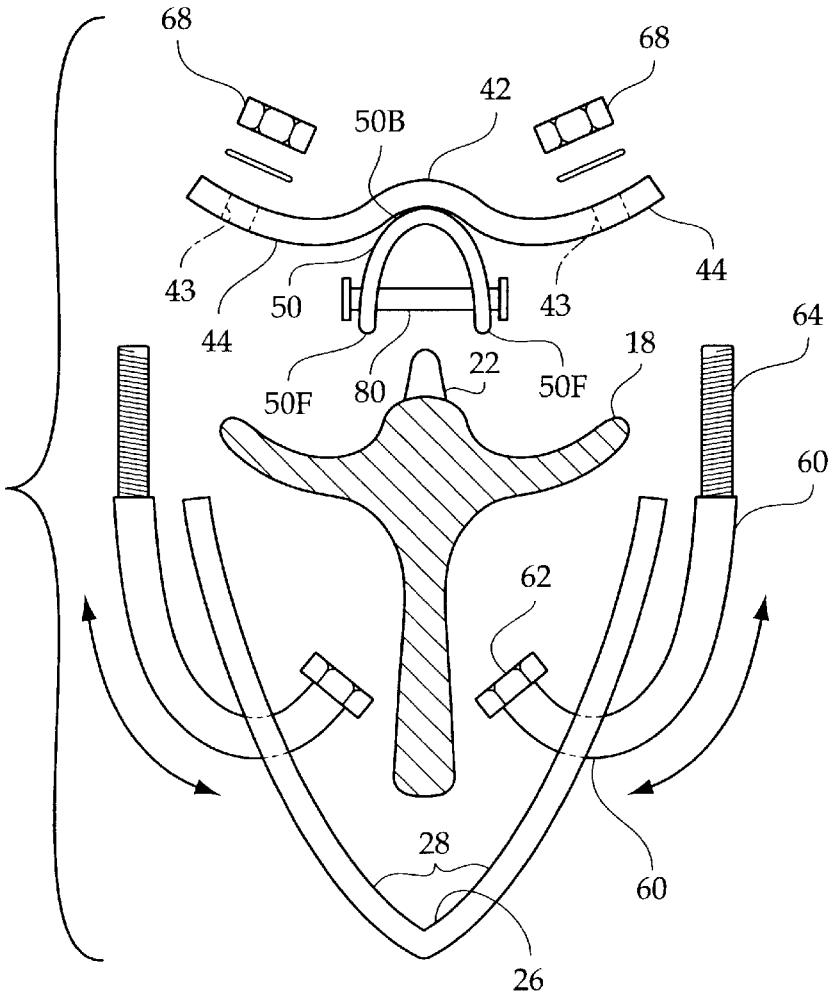
FIG. 4 is an exploded side elevational view, illustrating interconnection of one of the T-bars in the V-channel of one of the connectors, using the clamping mechanism.

In order to maintain the T-bars in their associated V-channels 24, a plurality of clamping mechanisms 40 are provided. Referring to FIG. 4 and FIG. 5, the clamping mechanisms 40 include a cross plate 42 which extends across the V-channel 24. The cross plate 42 has a pair of wings 44 at opposite ends thereof. The wings 44 are angled upward, such that the wings 44 form an obtuse angle with each other. An inverted U-channel 50 is mounted beneath the cross plate 42, such that the inverted U-channel 50 extends between the cross plate 42 and T-bar 18. The inverted U-channel 50 includes a bottom 50B and two free edges 50F opposite from said bottom 50B. The free edges 5OF directly engage the T-bar 18 when the clamping mechanism holds said T-bar 18 firmly against the vertex 26 of the V-channel. The U-channel 50 allows the clamping mechanism 40 to reliably engage the T-bar 18 without interference from one of the protuberances 22 spaced along the T-bar, regardless of the longitudinal position of the clamping mechanism 40 along the T-bar 18.

The cross plate 42 is held tightly to the V-channel with a pair of J-bolts 60. The J-bolts 60 each have a bolt head 62 and a threaded portion 64 fully opposite from the bolt head 62. The J-bolts 60 are hooked near the bolt head 62 and straighten toward the threaded portion 64.

Referring momentarily to FIG. 1, a plurality of bolt mounting holes 66 are present on each V-channel 24. The bolt mounting holes 66 are sized to allow the threaded portion 64 of the J-bolts 60 to extend therethrough. However, the bolt head 62 of each J-bolt 60 is too large to allow it to travel through one of the bolt mounting holes 66. Accordingly, as seen in FIG. 4 and FIG. 5, the bolt head 62 remains inside the 25 V-channel 24, and may even rest or be biased against one of the sides 28 of the V-channel, depending on tension exerted against the J-bolt by the cross plate 42, in a manner which will be described hereinafter.

As illustrated in FIG. 4 and FIG. 5, each cross plate 42 has a pair of cross plate bores 43, wherein one cross plate bore 43 is located on each of the wings 44 of said cross plate 42. The threaded portion 64 of each J-bolt 60 extends through one of the cross plate bores 43, and is fastened thereat with a nut 68. Accordingly, the cross plate 42 is held securely to the sides 28 of the V-channel, and the inverted U-channel 50 thereby holds the T-bar 18 tightly in place against the V-channel 24.

In order to ensure substantial tension between the cross plate 42 and v-channel 24, so as to maximize tension against the T-bar 18, a slit 70 is provided in the side 28 of the V-channel 24 directly above each bolt mounting hole 66 therein (see FIG. 1). The slit 70 extends fully through the V-channel side 28 from nearly adjacent to the bolt mounting hole 66 to the open end of said V-channel 24. The slit 70 is at least as wide as the diameter of the J-bolt 60, such that the slits allow the J-bolts to pivot inward further without interference from the sides 28 or the V-channel. Accordingly, the J-bolts 60 can pivot inward so that they extend substantially perpendicular to the wings 44 and axially with the cross plate bores 43 as seen in FIG. 5.

Although the T-bar 18 is held securely in place through tension exerted by the cross plate 42 and inverted U-channel 50, a transverse pin 80 is provided to prevent any significant longitudinal sliding of the T-bar 18 within the V-channel 24. The transverse pin 80 extends across the inverted U-channel 50 near the free ends 5OF thereof, and acts to interfere with the protuberances 22 spaced along the T-bar 18 if the T-bar 18 were to move longitudinally.

Because the fence is constructed using "T-bar stock", that is, arbitrary lengths of the T-bar cut to appropriate lengths for forming posts and rails, the protuberances 22 are not always in a predictable location. Accordingly if the transverse pin 80 were centered along the inverted U-channel 50, said pin 80 will often prevent the inverted U-channel 50 from seating properly on the T-bar 18. Accordingly, referring to FIG. 1, the inverted U-channel 50 has a first end 501 and a second end 502. The transverse pin 80 is located near the first end 501. In this manner, if when the clamping mechanism is being installed, the transverse pin 18 interferences with one of the protuberances, the entire cross plate 42 and inverted U-channel 50 may be rotated one hundred eighty degrees so that the U-channel 50 can properly seat upon the T-bar 18 without interferences between the protuberances 22 on the T-bar 18 and pin 80.

In conclusion, herein is presented a fencing system which allows a strong fence to be inexpensively and easily erected using commonly available T-bar material, wherein connectors according to the present invention allow a post and rail fence configuration to be easily achieved. The invention as described is illustrated by example in the accompanying drawing figures. Numerous variations are still possible, while adhering to the inventive concept. Such variations are contemplated as being a part of the present invention.

What is claimed is:

1. A fence system, for creating a fence using T-bars, wherein the T-bars form horizontal rails and vertical posts of the fence, comprising:

a plurality of connectors, each connector having at least two V-channels which meet at right angles, each V-channel having a pair of sides, a vertex which adjoins the sides, and an open end, the sides of said V-channel each having a plurality of bolt mounting holes extending therethrough adjacent to the vertex of said V-channel, the V-channels sized to accommodate the T-bars therein, such that the T-bars are secured therein to connect the horizontal rails and vertical posts of the fence;

a plurality of clamping mechanisms, each of the clamping mechanisms extend across the open end of one of the V-channels and fasten to the sides of said V-channel to maintain one of the T-bars securely therein, each clamping mechanism having a pair of J-bolts and a cross plate, wherein each J-bolt has a head on one end and a threaded portion at an opposite end therefrom, and the cross plate has two cross plate bores extending therethrough at substantially opposite ends of said cross plate;

wherein to secure the T-bar, the J-bolt extends through one of the bolt mounting holes with the head of said J-bolt resting inside said V-channel, the threaded end of said bolt extends through one of the holes in the cross plate, and is fastened tightly against said cross plate with a nut, such that the cross plate is thereby held tightly against the T-bar extending in said V-channel.

2. The fence system as recited in claim 1, wherein the T-bars have protuberances spaced longitudinally thereon, and wherein each of the clamping mechanisms further comprises a transverse pin which extends between the protuberances when the clamping mechanism is tightened against one of the T-bars to prevent said T-bar from longitudinal movement within the V-channel that it is mounted within.

3. The fence system as recited in claim 2, wherein each clamping mechanism further comprises an inverted U-channel, having a bottom and two free edges opposite from said bottom, the inverted U-channel longitudinally having a first end and a second end, the bottom is attached to the cross plate, the free edges engage the T-bar so that when the cross plate is tightened to the V-channel with the J-bolts, the free edges press the T-bar firmly against the vertex of the V-channel.

4. The fence system as recited in claim 3, wherein the transverse pin is mounted across the inverted U-channel and is located toward the first end, so that the cross plate and inverted U-channel can be rotated one hundred eighty degrees before firmly mounting the same if the free ends of the inverted U-channel cannot rest against the T-bar because one of the protuberances on the T-bar interferes with the transverse pin.

5. The fence system as recited in claim 4, wherein the connectors include at least one upper connector, the upper connector having a horizontal thru V-channel, and a vertical V-channel which extends perpendicular to the horizontal thru V-channel and terminates against one of the sides of the horizontal thru V-channel.

6. The fence system as recited in claim 5, wherein the connectors include at least one lower connector, the lower connector having a vertical thru V-channel, and a pair of horizontal V-channels, the horizontal V-channels extending perpendicular to the vertical thru V-channel, and wherein each of the horizontal V-channels terminate at one of the side walls of the vertical thru V-channels.

7. The fence system as recited in claim 6, wherein the cross plate has a pair of wings which are angled upward, each cross plate has a pair of cross plate bores, wherein one cross plate bore is located on each of said wings, and wherein a slit is located near each of the bolt mounting holes in the V-channel sides, said slit extending fully through said V-channel side and extending to the open end of said V-channel, each of said slits is at least as wide as the J-bolts, such that the J-bolts exit the bolt mounting holes and then hook inward through the slits in order to meet the cross plate perpendicular to the wings thereof so as to extend axially through the cross plate bores.

8. A fence system, for creating a fence having a plurality of sections, each section comprising:

a pair of posts, the posts made of T-bar material, the T-bar material being an elongated extruded bar of T-cross-sectional shape;

at least one horizontal rail, the horizontal rail made of the T-bar material;

a pair of connectors, the connectors each having a horizontal V-channel and a vertical V-channel, each of said V-channels having a pair of sides which meet at a vertex, and an open end, the sides of said V-channel each having a plurality of bolt mounting holes extending therethrough adjacent to the vertex of said V-channel, the horizontal rail mounted in the horizontal V-channels of the connectors, the posts each mounted in the vertical V-channel of one of the connectors; and a plurality of clamping mechanisms, each clamping mechanism extending across the open end of one of the V-channels and fasten to the sides of said V-channel for securing one of the T-bars within said V-channel, each clamping mechanism having a pair of J-bolts and a cross plate, wherein each J-bolt has a head on one end and a threaded portion at an opposite end therefrom, and the cross plate has two cross plate bores extending therethrough at substantially opposite ends of said cross plate;

wherein to secure the T-bar, the J-bolt extends through one of the bolt mounting holes with the head of said J-bolt resting inside said V-channel, the threaded end of said bolt extends through one of the holes in the cross plate, and is fastened tightly against said cross plate with a nut, such that the cross plate is thereby held tightly against the T-bar extending in said V-channel.

9. The fence system as recited in claim 8, wherein the T-bars have protuberances spaced longitudinally thereon, and wherein each of the clamping mechanisms further comprises a transverse pin which extends between the protuberances when the clamping mechanism is tightened against one of the T-bars to prevent said T-bar from longitudinal movement within the V-channel that it is mounted within.

10. The fence system as recited in claim 9, wherein each clamping mechanism further comprises an inverted U-channel, having a bottom and two free edges opposite from said bottom, the inverted U-channel longitudinally having a first end and a second end, the bottom is attached to the cross plate, the free edges engage the T-bar so that when the cross plate is tightened to the V-channel with the J-bolts, the free edges press the T-bar firmly against the vertex of the V-channel.

11. The fence system as recited in claim 10, wherein the transverse pin is mounted across the inverted U-channel and is located toward the first end, so that the cross plate and inverted U-channel can be rotated one hundred eighty degrees before firmly mounting the same if the free ends of the inverted U-channel cannot rest against the T-bar because one of the protuberances on the T-bar interferes with the transverse pin.

12. The fence system as recited in claim 11, wherein the connectors include at least one upper connector, the upper connector having a horizontal thru V-channel, and a vertical V-channel which extends perpendicular to the horizontal thru V-channel and terminates against one of the sides of the horizontal thru V-channel.

13. The fence system as recited in claim 12, wherein the connectors include at least one lower connector, the lower connector having a vertical thru V-channel, and a pair of horizontal V-channels, the horizontal V-channels extending perpendicular to the vertical thru V-channel, and wherein each of the horizontal V-channels terminate at one of the side walls of the vertical thru V-channels.

14. The fence system as recited in claim 13, wherein the cross plate has a pair of wings which are angled upward, each cross plate has a pair of cross plate bores, wherein one cross plate bore is located on each of said wings, and wherein a slit is located near each of the bolt mounting holes in the V-channel sides, said slit extending fully through said V-channel side and extending to the open end of said V-channel, each of said slits is at least as wide as the J-bolts, such that the J-bolts exit the bolt mounting holes and then hook inward through the slits in order to meet the cross plate perpendicular to the wings thereof so as to extend axially through the cross plate bores.

* * * * *